US012195154B2

(12) United States Patent
Kimpara et al.

(10) Patent No.: US 12,195,154 B2
(45) Date of Patent: Jan. 14, 2025

(54) OUTBOARD MOTOR

(71) Applicant: SUZUKI MOTOR CORPORATION, Hamamatsu (JP)

(72) Inventors: Masatoshi Kimpara, Hamamatsu (JP); Toshiya Kataoka, Hamamatsu (JP); Shingo Matsumoto, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 538 days.

(21) Appl. No.: 17/508,396

(22) Filed: Oct. 22, 2021

(65) Prior Publication Data

US 2022/0126964 A1 Apr. 28, 2022

(30) Foreign Application Priority Data

Oct. 28, 2020 (JP) ..... 2020-180203

(51) Int. Cl.

| | |
|---|---|
| ***B63H 20/12*** | (2006.01) |
| ***B63H 1/14*** | (2006.01) |
| ***B63H 20/02*** | (2006.01) |
| ***B63H 20/32*** | (2006.01) |
| ***B63H 23/34*** | (2006.01) |

(52) U.S. Cl.

CPC ..... *B63H 20/12* (2013.01); *B63H 1/14* (2013.01); *B63H 20/02* (2013.01); *B63H 20/32* (2013.01); *B63H 23/34* (2013.01)

(58) Field of Classification Search

CPC ..... B63H 20/00; B63H 20/02; B63H 20/08; B63H 20/12; B63H 20/32; B63H 1/00; B63H 1/14; B63H 23/00; B63H 23/34

USPC ..... 440/53

See application file for complete search history.

(56) References Cited

U.S. PATENT DOCUMENTS

| | | | | |
|---|---|---|---|---|
| 4,604,067 | A | 8/1986 | Roberts | 440/49 |
| 9,914,517 | B2 * | 3/2018 | Shomura | B63H 20/12 |
| 2005/0020150 | A1 | 1/2005 | Bernloehr | 440/58 |

FOREIGN PATENT DOCUMENTS

| | | | |
|---|---|---|---|
| JP | H 02-014996 | A | 1/1990 |
| JP | 2008-162331 | A | 7/2008 |

OTHER PUBLICATIONS

Notice of Reasons for Refusal dated Feb. 6, 2024, in corresponding application JP 2020-180203.

* cited by examiner

*Primary Examiner* — Lars A Olson
(74) *Attorney, Agent, or Firm* — Stein IP LLC

(57) ABSTRACT

An outboard motor includes a swivel bracket supporting a drive shaft housing such that the drive shaft housing is pivotable about an axis thereof and is movable in an axial direction thereof, a steering adjuster attached to the swivel bracket and configured to increase or reduce a rotational resistance force of the drive shaft housing against the swivel bracket, and at least one spacer mounted to the drive shaft housing at a position adjacent to at least one of both ends of the swivel bracket in the axial direction. In a state in which the spacer is mounted to the drive shaft housing, the drive shaft housing is restricted from moving in the axial direction with respect to the swivel bracket. A dimension from the swivel bracket to a rotation shaft of the propeller is changed by changing a mounting position of the spacer.

3 Claims, 6 Drawing Sheets

OUTBOARD MOTOR

CROSS-REFERENCE TO RELATED APPLICATIONS

The disclosure of Japanese Patent Application No. 2020-180203 filed on Oct. 28, 2020, including specification, drawings and claims is incorporated herein by reference in its entirety.

BACKGROUND

The present invention relates to an outboard motor to be attached to a transom board of a ship.

In an outboard motor attached to a transom board of a ship, it is important to appropriately set (adjust) a so-called transom height in order to appropriately transmit a propulsive force obtained by rotation of a propeller to water and obtain desired propulsion performance. Here, the transom height refers to a positional relationship between the transom board and the outboard motor, and specifically, refers to a height from an upper end surface of the transom board to an anti-ventilation plate (or a rotation shaft of the propeller) of the outboard motor.

For example, Patent Literature 1 discloses an outboard motor including a transom height adjusting mechanism that adjusts a transom height. The transom height adjusting mechanism adjusts the transom height by moving up and down a steering bracket, a pilot shaft, or the like by operating a hydraulic cylinder.

Patent Literature 1: JP-A-2008-162331

SUMMARY

According to one advantageous aspect of the present invention, there is provided an outboard motor configured to be attached to a transom board of a ship, the outboard motor including:

a drive shaft housing accommodating a drive shaft that transmits power of a power source to a propeller;

a swivel bracket supporting the drive shaft housing such that the drive shaft housing is pivotable about an axis thereof and is movable in an axial direction thereof;

a steering adjuster attached to the swivel bracket and configured to increase or reduce a rotational resistance force of the drive shaft housing against the swivel bracket; and at least one spacer mounted to the drive shaft housing at a position adjacent to at least one of both ends of the swivel bracket in the axial direction, in which in a state in which the spacer is mounted to the drive shaft housing, the drive shaft housing is restricted from moving in the axial direction with respect to the swivel bracket, and a dimension from the swivel bracket to a rotation shaft of the propeller is changed by changing a mounting position of the spacer.

DETAILED DESCRIPTION OF EXEMPLIFIED EMBODIMENTS

Figure 1:
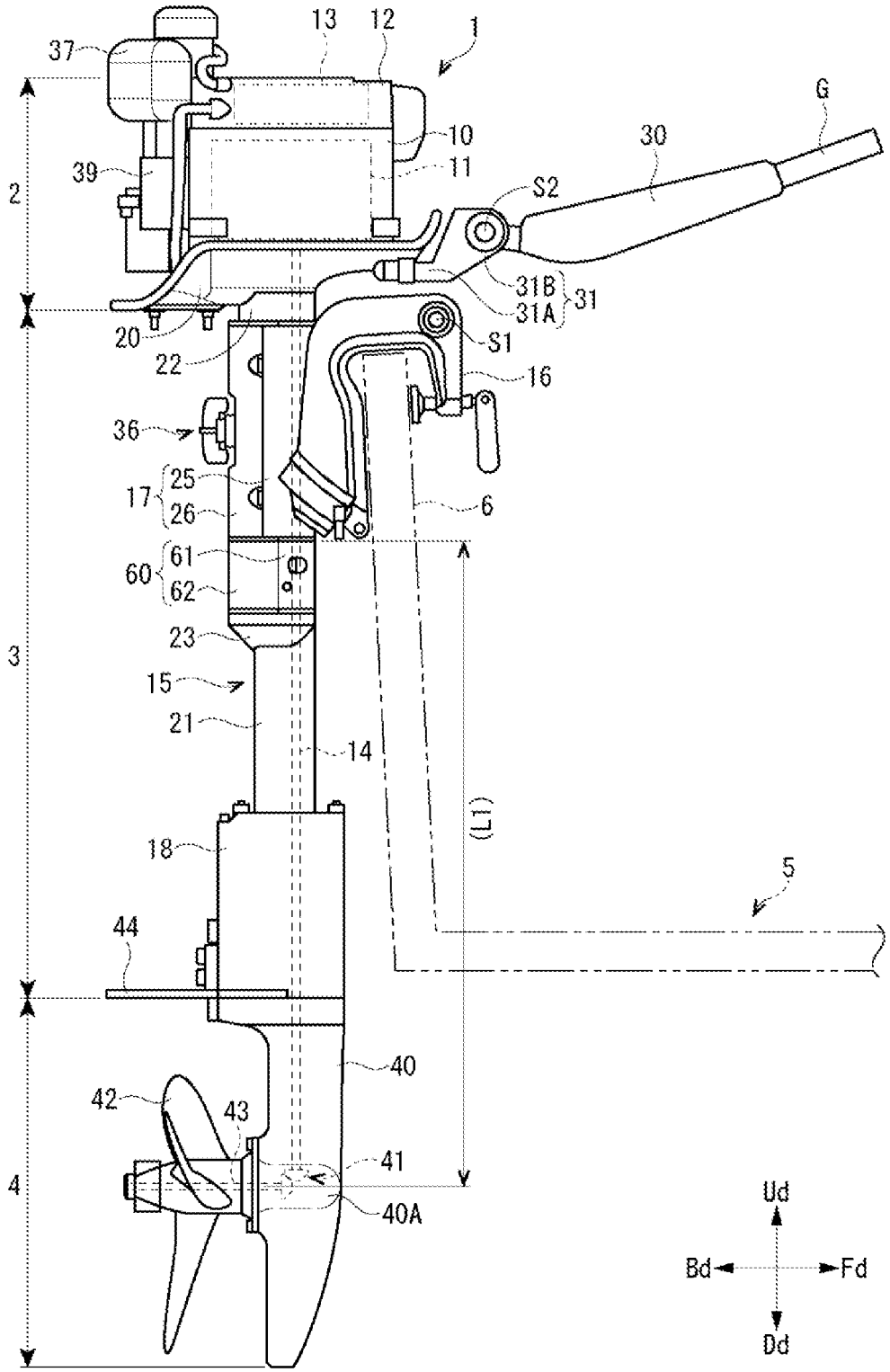
FIG. 1 is a right side view showing an outboard motor according to an embodiment of the present invention.

In the transom height adjusting mechanism in the Patent Literature 1, since a hydraulic cylinder and a device for controlling the hydraulic cylinder are required, there is a problem that a structure becomes complicated and manufacturing costs are increased. Therefore, the transom height adjusting mechanism described above is not suitable for, for example, a small outboard motor that is inexpensive and has a simple structure.

For example, in the case of a small output outboard motor using an electric motor as a power source, it is required to deal with the attachment of the outboard motor to various ships such as a rubber boat and a small ship, and a structure capable of easily adjusting the transom height is required.

The present invention has been made in view of the above problems, and an object of the present invention is to provide an outboard motor that can easily adjust a transom height.

An outboard motor according to an embodiment of the present invention is a device that is attached to a transom board of a ship and propels the ship. The outboard motor includes a drive shaft housing accommodating a drive shaft that transmits power of a power source to a propeller, a swivel bracket supporting the drive shaft housing such that the drive shaft housing is pivotable about an axis thereof and is movable in an axial direction thereof, a steering adjuster attached to the swivel bracket and configured to increase or reduce a rotational resistance force of the drive shaft housing against the swivel bracket, and at least one spacer mounted to the drive shaft housing at a position adjacent to at least one of both ends of the swivel bracket in the axial direction. In a state in which the spacer is mounted to the drive shaft housing, the drive shaft housing is restricted from moving in the axial direction with respect to the swivel bracket. A dimension from the swivel bracket to a rotation shaft of the propeller is changed by changing a mounting position of the spacer.

For example, when the spacer is mounted to the drive shaft housing at a position adjacent to a lower end of the swivel bracket, the swivel bracket is relatively lifted up by a height of the spacer, and the drive shaft housing is pulled down with respect to the swivel bracket (a long specification). For example, when the spacer is mounted to the drive shaft housing at a position adjacent to an upper end of the swivel bracket, the swivel bracket is relatively pulled down by a height of the spacer, and the drive shaft housing is lifted up with respect to the swivel bracket (a short specification). A dimension from the swivel bracket (for example, a lower end surface) to a rotation shaft (an axial center) of the propeller is larger in the long specification than that in the short specification. In this manner, the dimension from the swivel bracket to the rotation shaft of the propeller is changed by changing a mounting position of the spacer.

Accordingly, a transom height can be easily adjusted by a simple operation of changing the mounting position of the spacer.

An outboard motor according to an embodiment of the present invention will be described below with reference to the drawings. In the embodiment, an upper side (Ud), a lower side (Dd), a front side (Fd), a rear side (Bd), a left side (Ld), and a right side (Rd) are set based on an upper side, a lower side, a front side, a rear side, a left side, and a right side of an occupant who boards a ship to which an outboard motor is attached and faces a forward direction of the ship. These directions are indicated by arrows shown in the drawings.

Figure 2:
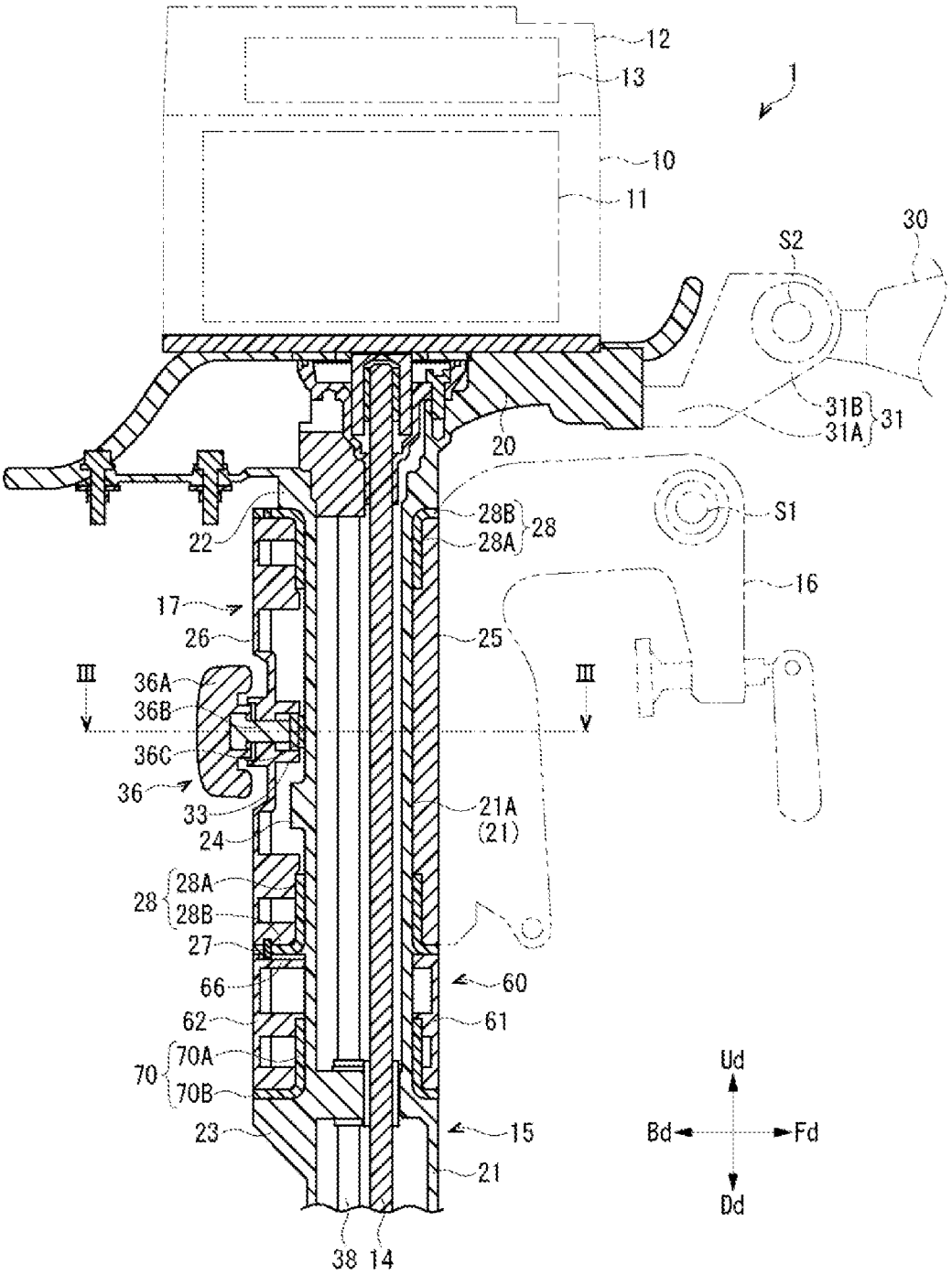
FIG. 2 is a vertical cross-sectional view showing a part of the outboard motor according to the embodiment of the present invention as viewed from a right side.
Figure 3:
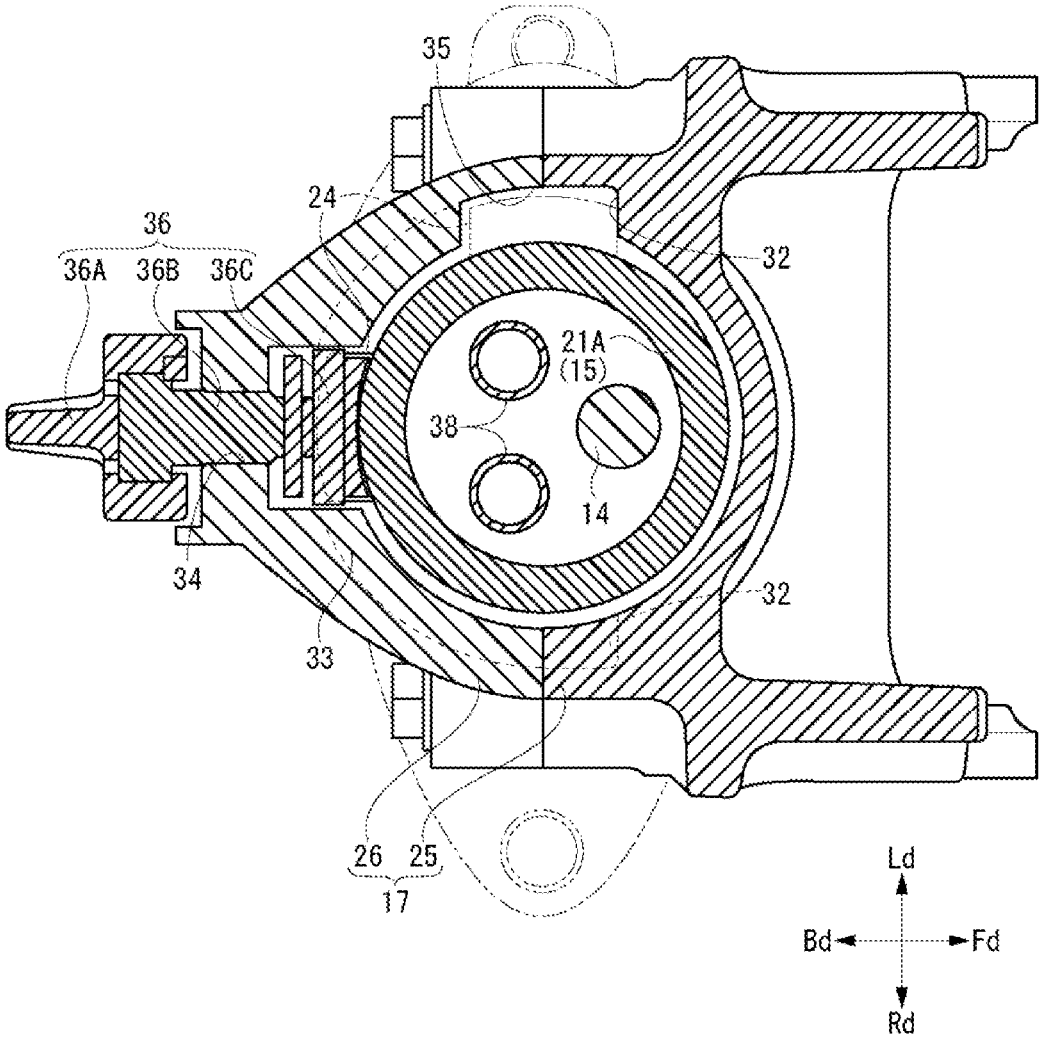
FIG. 3 is a cross-sectional view taken along a line III-III in FIG. 2.

An overall configuration of an outboard motor 1 will be described with reference to FIGS. 1 to 3. FIG. 1 is a right side view showing the outboard motor 1. FIG. 2 is a vertical cross-sectional view showing a part of the outboard motor 1 as viewed from the right side. FIG. 3 is a cross-sectional view taken along a line III-III in FIG. 2. FIG. 2 is a cross-sectional view taken in a case where the outboard motor 1 is cut off at the center of the outboard motor 1 in a left-right direction.

As shown in FIG. 1, the outboard motor 1 is a device that is attached to a transom board 6 of a ship 5 and propels the ship 5. The outboard motor 1 according to the present embodiment is an electric outboard motor 1 using an electric motor 11 as a power source, and is a small output outboard motor suitable for the small ship 5. In the embodiment, as shown in FIG. 1, a term "axial direction" used in the claims refers to an upper-lower direction in a state in which the outboard motor 1 is attached to the ship 5 and is in usage.

The outboard motor 1 includes an upper unit 2, a middle unit 3, and a lower unit 4. The upper unit 2 constitutes an upper portion of the outboard motor 1, and the lower unit 4 constitutes a lower portion of the outboard motor 1. The middle unit 3 is provided between the upper unit 2 and the lower unit 4.

[Upper Unit]

As shown in FIG. 1, the upper unit 2 includes a motor case 10, the electric motor 11, an inverter case 12, and an inverter 13.

The electric motor 11 serving as an example of a power source is housed in the motor case 10. An upper end portion of a drive shaft 14 is connected to an output shaft of the electric motor 11. The drive shaft 14 extends downward from the electric motor 11. The drive shaft 14 is rotated about an axis by power of the electric motor 11, and transmits the power of the electric motor 11 to a propeller 42 (to be described later). The inverter 13 is disposed above the electric motor 11 and is housed in the inverter case 12. The inverter 13 controls driving of the electric motor 11.

[Middle Unit]

As shown in FIG. 1, the middle unit 3 includes a drive shaft housing 15, a clamp bracket 16, a swivel bracket 17, and a heat sink 18.

<Drive Shaft Housing>

As shown in FIGS. 1 and 2, the drive shaft housing 15 is provided below the motor case 10 and accommodates the drive shaft 14 therein. The drive shaft housing 15 includes a housing connection portion 20 connected to a lower end of the motor case 10, and a housing extension portion 21 extending downward from a lower end of the housing connection portion 20. The housing connection portion 20 and the housing extension portion 21 are integrally molded. The housing connection portion 20 is formed in a manner of being narrowed and tapered downward from the motor case 10 in a side view. The housing extension portion 21 is formed into a substantially cylindrical shape elongated in the upper-lower direction.

An upper end restricting portion 22 and a lower end restricting portion 23 are formed at an upper end portion of the housing extension portion 21 and an intermediate portion in the upper-lower direction of the housing extension portion 21 in a manner in which the upper end restricting portion 22 and the lower end restricting portion 23 protrude radially outward. Here, The upper end restricting portion 22 and the lower end restricting portion 23 may be formed in the vicinity of a boundary between the housing extension portion 21 and the housing connection portion 20 at the upper end portion of the housing extension portion 21. The upper end restricting portion 22 and the lower end restricting portion 23 are formed into a substantial flange shape, and the swivel bracket 17 to be described later is attached to the housing extension portion 21 between the upper end restricting portion 22 and the lower end restricting portion 23 in a manner in which the swivel bracket 17 is movable in the upper-lower direction. In the present description, the housing extension portion 21 between the upper end restricting portion 22 and the lower end restricting portion 23 is referred to as a sliding portion 21A. The housing extension portion 21 extending downward from the lower end restricting portion 23 is formed in a manner of being flush with a front peripheral surface of the lower end restricting portion 23. Although the housing connection portion 20 is a part of the drive shaft housing 15, the housing connection portion 20 may be regarded as a part of the upper unit 2.

As shown in FIG. 2, a pivoting restricting protrusion 24 is formed at an intermediate portion of the sliding portion 21A in the upper-lower direction in a manner of protruding radially outward from a rear peripheral surface of the sliding portion 21A. The pivoting restricting protrusion 24 is a protrusion having a substantially rectangular parallelepiped shape protruding from the rear peripheral surface of the sliding portion 21A.

<Clamp Bracket>

As shown in FIG. 1, the clamp bracket 16 is provided to fix the outboard motor 1 to the transom board 6 of the ship 5. The clamp bracket 16 is formed into a substantially U shape that is vertically inverted when viewed from a side surface, covers the transom board 6 from above, and sandwiches the transom board 6. Although not clearly shown in FIG. 1, the clamp bracket 16 is formed into a shape of a pair of left and right arms in a plan view. The swivel bracket 17 which will be described later is pivotably supported via a tilt shaft S1 installed at the pair of left and right arm portions of the clamp bracket 16. The outboard motor 1 is tilted (tilted up, tilted down) with respect to the ship 5 by pivoting (swinging) the swivel bracket 17 in the upper-lower direction about the tilt shaft S1.

<Swivel Bracket>

As shown in FIG. 2, the swivel bracket 17 supported by the clamp bracket 16 is disposed in a manner of surrounding the sliding portion 21A of the drive shaft housing 15 via a pair of upper and lower bushes 28. The swivel bracket 17 supports the drive shaft housing 15 such that the drive shaft housing 15 can be pivoted about an axis. A dimension in the upper-lower direction of the swivel bracket 17 is set to be smaller than a dimension of the sliding portion 21A of the drive shaft housing 15. Here, the dimension of the sliding portion 21A may be defined as a distance between the upper end restricting portion 22 and the lower end restricting portion 23. The swivel bracket 17 supports the drive shaft housing 15 such that the drive shaft housing 15 can move in the upper-lower direction.

As shown in FIGS. 1 to 3, the swivel bracket 17 is formed into a substantially cylindrical shape that can be divided into a swivel front portion 25 and a swivel rear portion 26. The front swivel front portion 25 at a front side is disposed between the pair of clamp brackets 16. The swivel rear portion 26 at a rear side is coupled to the swivel front portion 25 via a fastening member such as a bolt with the drive shaft housing 15 (sliding portion 21A) interposed between the swivel rear portion 26 and the swivel front portion 25. In a plan view (or a cross-sectional view) of the swivel bracket 17, the swivel front portion 25 has a semicircular outer shape, the swivel rear portion 26 has an outer shape extending rearward while being narrowed, and the swivel bracket 17 as a whole is formed to have a substantial droplet outer shape (see FIG. 3). A circular opening in which the sliding portion 21A is disposed is formed in an axial center portion of the swivel bracket 17 (see FIG. 3).

As shown in FIG. 2, the bush 28 is formed of, for example, a bearing material such as a synthetic resin or a metal having wear resistance. Similar to the swivel bracket 17, the bush 28 is formed into a substantially cylindrical shape that can be divided in a front-rear direction. The bush 28 includes a cylindrical portion 28A inserted into the opening formed in the axial center portion of the swivel bracket 17, and a flange portion 28B that extends radially outward from an end portion of the cylindrical portion 28A and is in contact with an end surface of the swivel bracket 17. The bush 28 that is divided (cylindrical portions 28A) is fitted inside the swivel front portion 25 and the swivel rear portion 26. Although the bush 28 is a member separate from the swivel bracket 17, the bush 28 may be regarded as a part of the swivel bracket 17. A recessed portion into which a rotation stop protrusion 27 is inserted is formed in each of both end surfaces in the upper-lower direction of the swivel rear portion 26 and the flange portion 28B of each of the pair of upper and lower bushes 28.

(Handle and Attachment)

As shown in FIGS. 1 and 2, the outboard motor 1 is provided with a handle 30 that pivots (swings) the drive shaft housing 15. The handle 30 is attached to a front side of the housing connection portion 20 of the drive shaft housing 15 via an attachment 31. A base end portion of the handle 30 is coupled to the attachment 31 via a handle shaft S2 extending in the left-right direction, and is provided in a manner of being pivotable in the upper-lower direction about the handle shaft S2. A throttle grip G for operating a rotation speed of the electric motor 11 is provided at a tip end portion of the handle 30 (see FIG. 1). The attachment 31 is coupled to an upper portion (the housing connection portion 20) of the drive shaft housing 15 and supports the handle 30. The attachment 31 is formed into a stepped shape in the upper-lower direction between a coupling portion 31A coupled to the drive shaft housing 15 and a support portion 31B that supports the handle 30.

(Pivoting Restricting Portion)

As shown in FIG. 3, the swivel front portion 25 is provided with a pair of left and right pivoting restricting portions 32 with the drive shaft housing 15 interposed between the left and right pivoting restricting portions 32. Each of the pivoting restricting portions 32 is a portion that abuts against the pivoting restricting protrusion 24 of the drive shaft housing 15 that is pivoted by approximately 90 degrees to the left or right with respect to the swivel bracket 17. Accordingly, pivoting of the drive shaft housing 15 with respect to the swivel bracket 17 is restricted. Therefore, a maximum steering angle of the outboard motor 1 is an angle at which the drive shaft housing 15 is pivoted from a steering position (neutral position) where the ship 5 travels straight until the pivoting of the drive shaft housing 15 is restricted, and the maximum steering angle of the outboard motor 1 is set to approximately 90 degrees in the left-right direction. The maximum steering angle is not limited to be an angle of approximately 90 degrees in the left-right direction, and may be less than 90 degrees or may exceed 90 degrees.

(Steering Adjuster)

As shown in FIGS. 1 to 3, a steering adjuster 36 is attached to a rear surface at a substantially central portion in the upper-lower direction of the swivel rear portion 26.

Specifically, as shown in FIGS. 2 and 3, a protruding portion 33 that protrudes radially inward from an inner surface of the swivel rear portion 26 (swivel bracket 17) is formed at a substantially central portion in the upper-lower direction of the swivel rear portion 26, and the steering adjuster 36 is attached to the protruding portion 33. The protruding portion 33 is formed into a band shape (or a substantially semicircular ring shape) that is curved along an inner surface of the swivel rear portion 26 in a plan view (see FIG. 3). A screw hole 34 (female screw) is formed in a manner of passing through the protruding portion 33 from a rear surface of the swivel rear portion 26 (see FIG. 3).

As shown in FIGS. 2 and 3, the steering adjuster 36 includes a pinching portion 36A, a screw portion 36B that extends radially inward from the pinching portion 36A, and a pressing portion 36C provided at a tip end of the screw portion 36B. The pinching portion 36A is a portion to be pinched by a user in order to rotate the screw portion 36B. The screw portion 36B is a male screw that is screwed into the screw hole 34. The pressing portion 36C is an elastic body such as a rubber pad and is in contact with a peripheral surface of the drive shaft housing 15.

The steering adjuster 36 described above has a function of increasing or decreasing a rotational resistance force of the drive shaft housing 15 against the swivel bracket 17. For example, when the user rotates the pinching portion 36A to screw the screw portion 36B, the pressing portion 36C is pressed against the peripheral surface of the drive shaft housing 15, and pivoting resistance of the drive shaft housing 15 is increased. On the other hand, when the user rotates the pinching portion 36A to pull back the screw portion 36B, the pressing of the pressing portion 36C against the peripheral surface of the drive shaft housing 15 is reduced, and the pivoting resistance of the drive shaft housing 15 is reduced.

As shown in FIG. 3, the protruding portion 33 is not formed at one end side (the left side in FIG. 3) in the left-right direction in a plan view. Accordingly, a passage allowing portion 35 serving as a space in which the protruding portion 33 is not present is formed in the vicinity of a left joint between the swivel front portion 25 and the swivel rear portion 26. The passage allowing portion 35 is formed to allow the pivoting restricting protrusion 24 (see a portion indicated by a two-dot chain line in FIG. 3) that abuts against the left pivoting restricting portion 32 to pass through the passage allowing portion 35 in the upper-lower direction. Therefore, the drive shaft housing 15 can move in the upper-lower direction by pivoting the drive shaft housing 15 about an axis up to a maximum steering angle (a predetermined angle) with respect to the swivel bracket 17.

<Heat Sink>

As shown in FIG. 1, a cooling device for cooling the electric motor 11 and the inverter 13 is formed by the heat sink 18, a tank 37, a cooling water passage 38 (see FIG. 2), and a pump 39. The heat sink 18 is coupled to a lower end of the drive shaft housing 15 and has a function of cooling cooling water. The heat sink 18 is formed into a cylindrical shape that is wider in the front-rear direction than the housing extension portion 21 of the drive shaft housing 15. The tank 37 is provided at a rear side of the inverter case 12 in order to store cooling water. The cooling water passage 38 is provided inside the motor case 10, the drive shaft housing 15, and the like so as to circulate cooling water through the electric motor 11, the inverter 13, and the heat sink 18. The pump 39 is provided at a rear side of the motor case 10, and has a function of circulating cooling water in the electric motor 11, the inverter 13, and the heat sink 18 via the cooling water passage 38. An example of the cooling water includes an antifreeze solution containing ethylene glycol as a main component.

[Lower unit]

As shown in FIG. 1, the lower unit 4 includes a gear case 40, a gear mechanism 41, and the propeller 42.

<Gear Case>

The gear case 40 is coupled to a lower end of the heat sink 18. The gear case 40 has a shape in which a portion from an upper end portion of the gear case 40 to a gear mechanism housing portion 40A that houses the gear mechanism 41 is narrowed and tapered in a front view. A portion of the gear case 40 extending downward from the gear mechanism housing portion 40A is formed in a plate shape so as to function as a rudder. An anti-ventilation plate 44 extends rearward at a lower end portion of the drive shaft housing 15, that is, in the vicinity of a boundary between the drive shaft housing 15 and the gear case 40. The anti-ventilator plate 44 has a function of preventing air from flowing from the water surface into the propeller 42.

<Gear Mechanism>

The gear mechanism 41 is housed in the gear mechanism housing portion 40A of the gear case 40. A lower side of the drive shaft 14 enters the gear case 40 and is connected to the gear mechanism 41. The gear mechanism 41 includes a propeller shaft 43 (a rotation shaft) extending in the front-rear direction, and a rear portion of the propeller shaft 43 protrudes rearward from the gear case 40. The propeller 42 is attached to the rear portion of the propeller shaft 43. The gear mechanism 41 transmits rotation of the drive shaft 14 about an axis to the propeller shaft 43 (the propeller 42). The propeller 42 is rotated about an axis underwater to generate a propulsive force for propelling the ship 5.

In the outboard motor 1, it is important to appropriately set a positional relationship between the transom board 6 of the ship 5 and the outboard motor 1 in order to appropriately transmit a propulsive force obtained by the rotation of the propeller 42 to water and obtain desired propulsion performance. Specifically, it is necessary to appropriately set a height (so-called transom height) from an upper end surface of the transom board 6 to the anti-ventilation plate 44 of the outboard motor 1 (or a rotation shaft (axial center) of the propeller 42 or an axial center of the propeller shaft 43). As a result of appropriately setting the transom height, a water depth (propeller water depth) from the water surface to a rotation shaft of the propeller 42 is appropriate, the propulsive force obtained by the rotation of the propeller 42 can be efficiently transmitted to water, and desired propulsion performance can be obtained.

Therefore, in order to easily adjust the transom height, the outboard motor 1 according to the present embodiment includes a spacer 60 mounted on the drive shaft housing 15 at a position adjacent to an upper end or a lower end of the swivel bracket 17.

[Spacer]

Figure 4A:
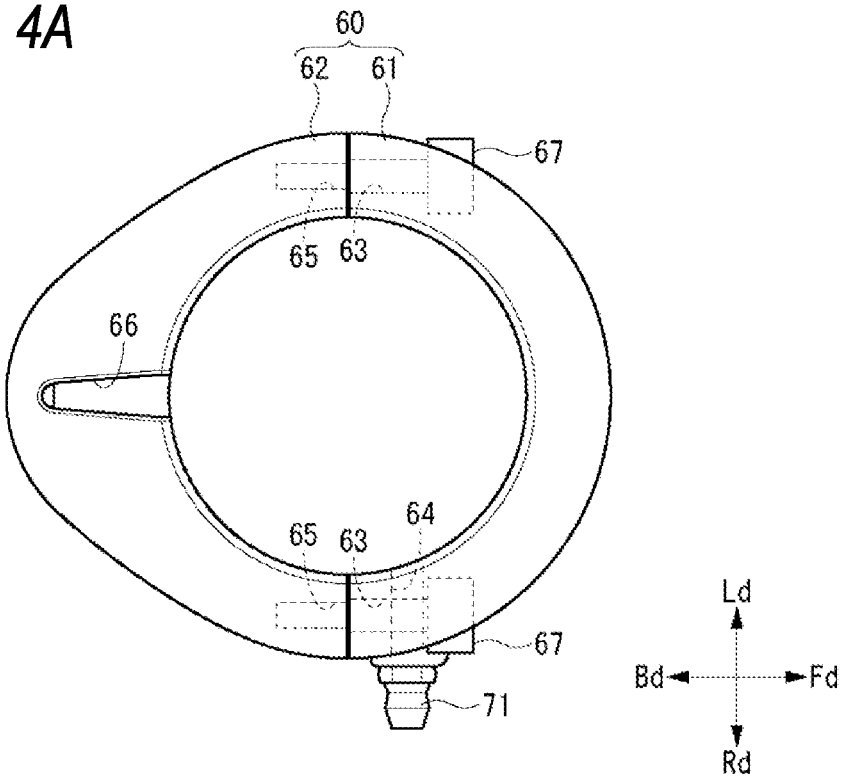
FIG. 4A is a plan view showing a spacer of the outboard motor according to the embodiment of the present invention.
Figure 4B:
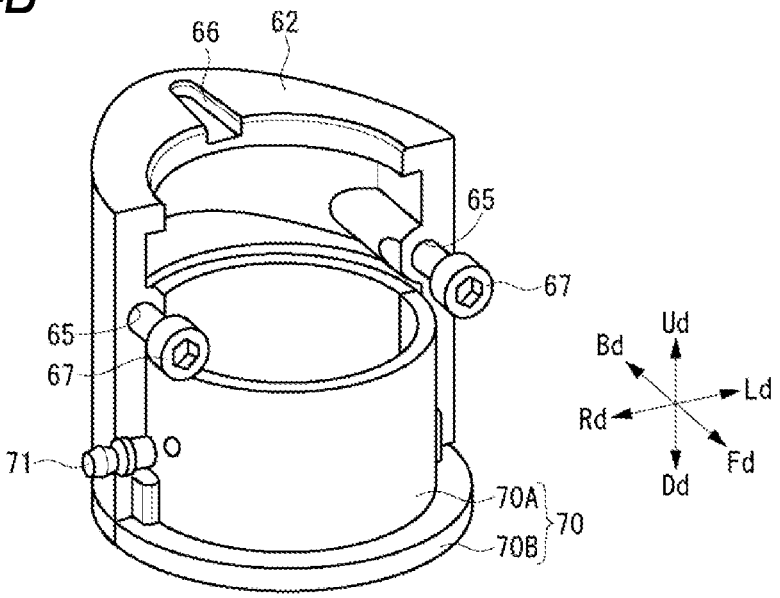
FIG. 4B is a perspective view showing a spacer front portion, a bush, and the like of the outboard motor according to the embodiment of the present invention.

The spacer 60 will be described mainly with reference to FIGS. 4A and 4B. FIG. 4A is a plan view showing the spacer 60. FIG. 4B is a perspective view showing a spacer front portion 61, a bush 70, and the like.

The spacer 60 is made of, for example, a metal such as an aluminum alloy, and is formed into a substantially cylindrical shape. The spacer 60 is disposed in a manner of surrounding the sliding portion 21A of the drive shaft housing 15 via the bush 70 (see FIG. 2). The spacer 60 is formed into a substantially cylindrical shape that can be divided into the spacer front portion 61 and a spacer rear portion 62. As shown in FIG. 4A, the spacer 60 is formed into substantially the same shape as the swivel bracket 17 in a plan view. Therefore, the spacer front portion 61 has a semicircular outer shape, and the spacer rear portion 62 has an outer shape extending rearward while being narrowed, and the spacer 60 as a whole has a substantially droplet outer shape. A circular opening in which the sliding portion 21A is disposed is formed in an axial center portion of the spacer 60.

A pair of left and right bolt through holes 63 through which bolts 67 pass in the front-rear direction are formed in a front peripheral surface of the spacer front portion 61. A nipple through hole 64 through which a grease nipple 71 of a bush 70 which will be described later passes in the left-right direction is formed in a right peripheral surface of the spacer front portion 61. A pair of left and right screw holes 65 (female screws) are formed in a dividing surface of the spacer rear portion 62 at a rear side (see FIG. 4B). A rotation stop recessed portion 66 to which the rotation stop protrusion 27 provided on the swivel bracket 17 (the swivel rear portion 26) is fitted is formed in a recessed manner on one end surface in the upper-lower direction of the spacer rear portion 62.

As shown in FIG. 4B, the bush 70 has substantially the same structure as the bush 28 provided on the swivel bracket 17. That is, the bush 70 is made of a bearing material having wear resistance, and is formed into a substantially cylindrical shape that can be divided in the front-rear direction in a similar manner to the spacer 60. The bush 70 includes a cylindrical portion 70A and a flange portion 70B. The cylindrical portion 70A is inserted into the opening formed in the axial center portion of the spacer 60 from the other side in the axial direction of the spacer 60 (a side where the rotation stop recessed portion 66 is not formed). The flange portion 70B is in contact with the other end surface of the spacer 60 in the axial direction.

The grease nipple 71 protrudes radially outward from a right peripheral surface of the cylindrical portion 70A of the bush 70 at a front side. The bush 70 at a front side after being divided is fitted into the spacer front portion 61 in a state in which the grease nipple 71 passes through the nipple through hole 64. The bush 70 at a rear side after being divided is fitted into the spacer rear portion 62. Grease injected from the grease nipple 71 is interposed between the spacer 60 (the swivel bracket 17) and the drive shaft housing 15 and lubricates the drive shaft housing 15. Although the bush 70 is a member separate from the spacer 60, the bush 70 may be regarded as a part of the spacer 60.

[Transom Height Adjusting Operation]

Figure 5:
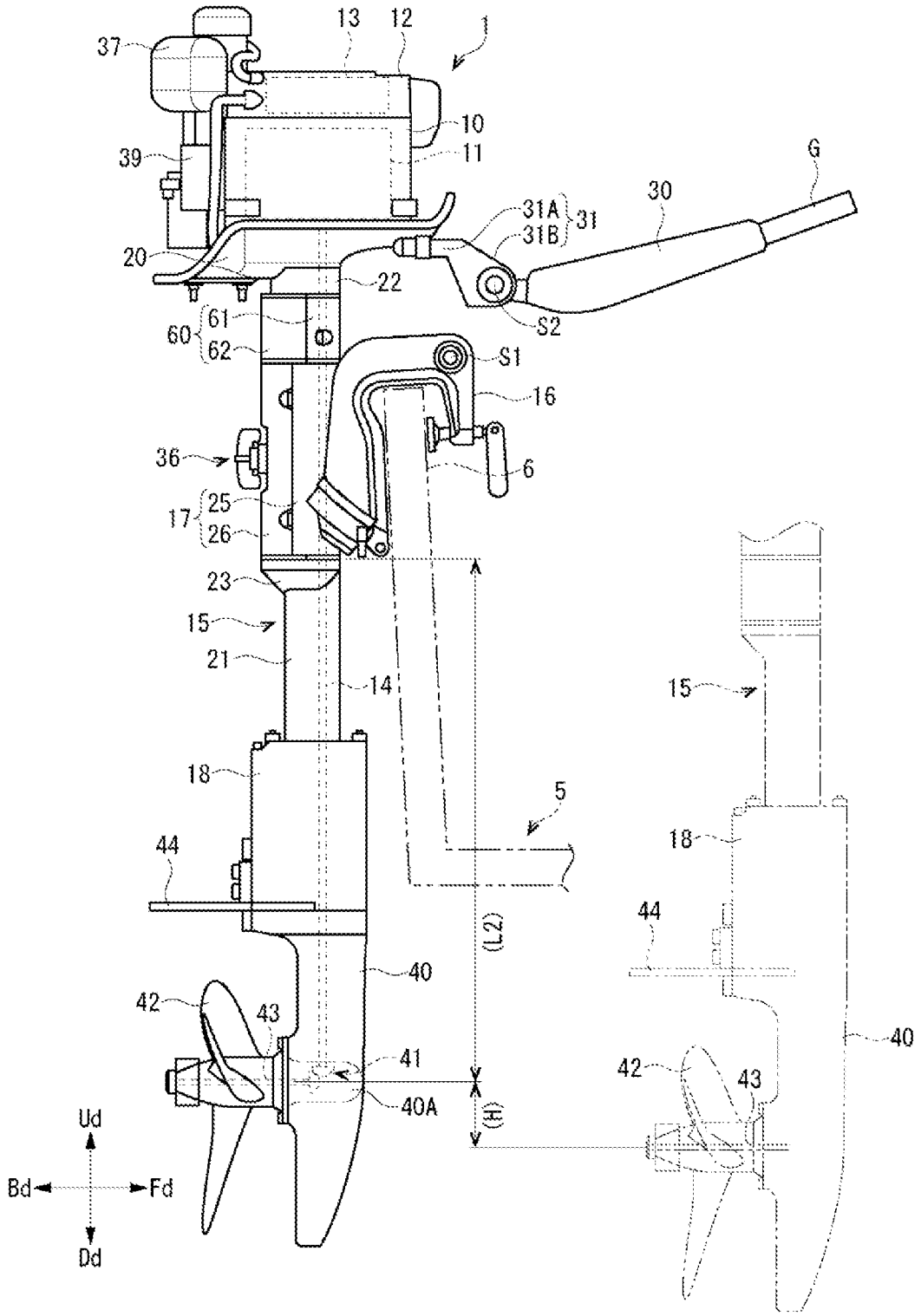
FIG. 5 is a right side view showing the outboard motor (short specification) according to the embodiment of the present invention.
Figure 6:
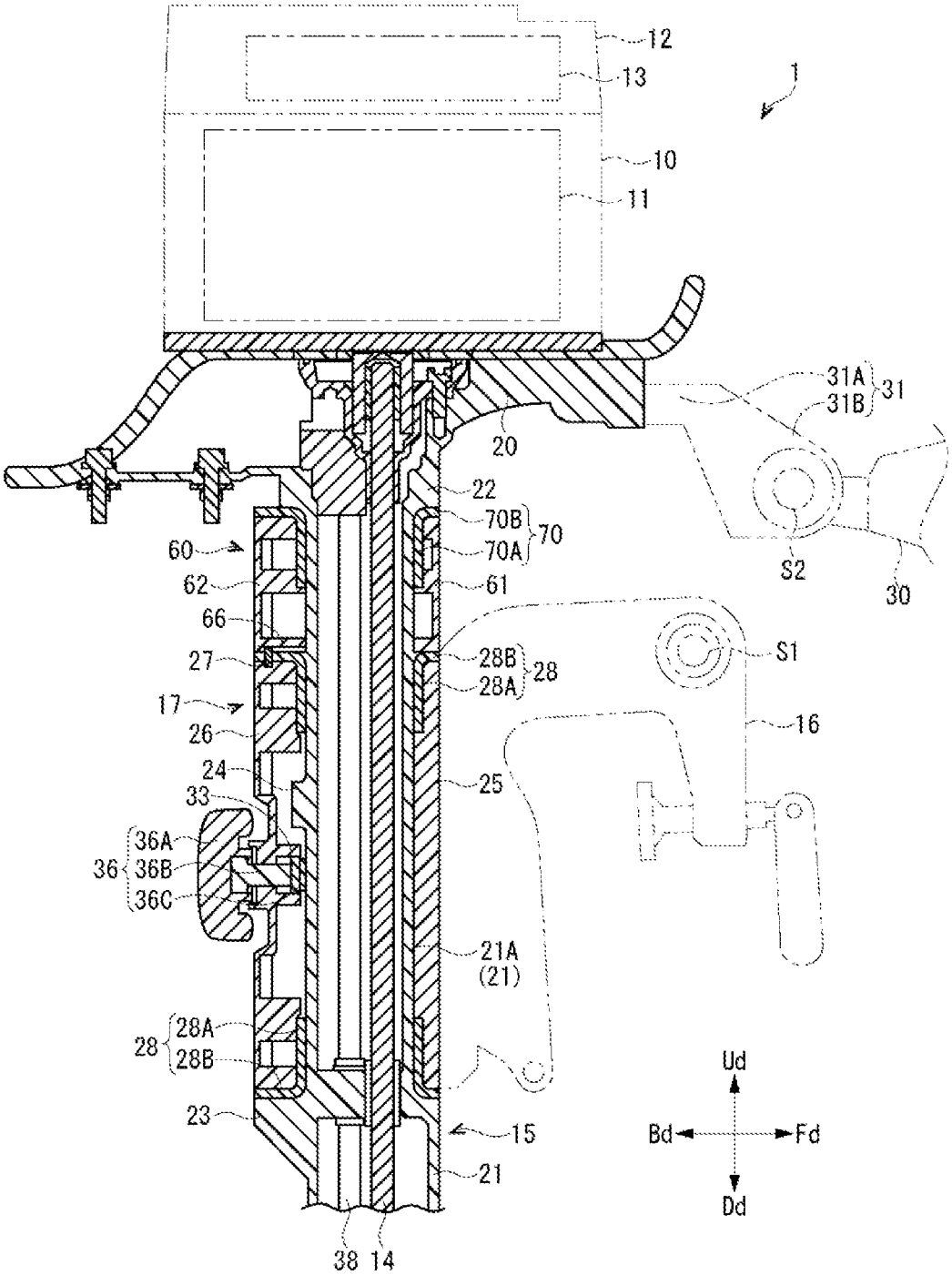
FIG. 6 is a vertical cross-sectional view showing a part of the outboard motor (short specification) according to the embodiment of the present invention as viewed from a right side.

Next, an example of a transom height adjusting operation using the spacer 60 will be described with reference to FIGS. 1, 2, 5, and 6. FIG. 5 is a right side view showing the outboard motor 1 (the short specification). FIG. 6 is a vertical cross-sectional view showing a part of the outboard motor 1 (the short specification) as viewed from the right side.

<Overview of Spacer Mounting>

The spacer rear portion 62 is disposed such that the spacer rear portion 62 and the spacer front portion 61 sandwiches the drive shaft housing 15 (the sliding portion 21A), and the spacer rear portion 62 is coupled to the spacer front portion 61 by screwing the bolt 67 that passes through the bolt through hole 63 into the screw hole 65. Accordingly, the spacer 60 is mounted to the sliding portion 21A via the bush 70 at a position adjacent to an upper end or a lower end of the swivel bracket 17 (see FIGS. 1 and 5). Specifically, the spacer 60 is provided to fill a space (see FIG. 1) between the lower end of the swivel bracket 17 and the lower end restricting portion 23 of the drive shaft housing 15 or a space (see FIG. 5) between the upper end of the swivel bracket 17 and the upper end restricting portion 22 of the drive shaft housing 15. A total height of the swivel bracket 17 and the spacer 60 is substantially equal to a height of the sliding portion 21A of the drive shaft housing 15 (the distance between the upper end restricting portion 22 and the lower end restricting portion 23). Therefore, in a state in which the spacer 60 is mounted to the drive shaft housing 15, the drive shaft housing 15 is restricted from moving in the upper-lower direction (axial direction) with respect to the swivel bracket 17.

<Long Specification>

A case where the spacer 60 is mounted to the sliding portion 21A at a position adjacent to the lower end of the swivel bracket 17 will be described with reference to FIGS. 1 and 2. The spacer 60 is in a posture in which the rotation stop recessed portion 66 faces upward, and the rotation stop protrusion 27 provided on a lower end surface of the swivel bracket 17 is fitted to the rotation stop recessed portion 66 of the spacer 60, thereby preventing the spacer 60 from rotating about an axis. When the spacer 60 is mounted to the drive shaft housing 15 at a position adjacent to the lower end of the swivel bracket 17, the swivel bracket 17 is relatively lifted up by a height of the spacer 60, and the drive shaft housing 15 is pulled down with respect to the swivel bracket 17. Therefore, the outboard motor 1 has a long specification in which a dimension (L1) from a position (for example, a lower end surface) of the swivel bracket 17 to a rotation shaft (axial center) of the propeller 42 is extended by the height of the spacer 60 (see FIG. 1). That is, the outboard motor 1 has a specification in which a transom height is set to be long.

In the case of the long specification, since an upper portion (the housing connection portion 20) of the drive shaft housing 15 comes close to an upper end of the transom board 6 (or the clamp bracket 16) of the ship 5, it is preferable that the handle 30 is provided at a position separated upward from the upper end of the transom board 6. Therefore, as shown in FIGS. 1 and 2, in the case of the long specification, the attachment 31 is fixed to the drive shaft housing 15 in a posture in which the support portion 31B is positioned above the coupling portion 31A.

The handle 30 coupled to the support portion 31B is provided at a position separated upward from the upper end of the transom board 6.

<Change from Long Specification to Short Specification>

Next, a case where the transom height is changed from the long specification to a low setting state (the short specification to be described later) will be described with reference to FIGS. 5 and 6 mainly. FIG. 5 shows a part of the outboard motor 1 of the long specification (see FIG. 1) by a two-dot chain line so as to compare with the outboard motor 1 of the short specification.

A user positions the drive shaft housing 15 (the handle 30) at an angle other than a right maximum steering angle, removes the bolts 67 of the spacer 60, and divides the spacer 60 into the spacer front portion 61 and the spacer rear portion 62. The rotation stop protrusion 27 provided on the lower end surface of the swivel bracket 17 is pulled out. In this state, since a lower surface of the protruding portion 33 for attaching the steering adjuster 36 interferes with an upper end of the pivoting restricting protrusion 24 that is a part of the drive shaft housing 15, the drive shaft housing 15 is restricted from moving upward with respect to the swivel bracket 17. As described above, when the spacer 60 adjacent to a lower end of the swivel bracket 17 is removed, the drive shaft housing 15 is positioned at an angle other than the right maximum steering angle. The present invention is not limited thereto, and the drive shaft housing 15 may be positioned at the right maximum steering angle.

Next, the user pivots the drive shaft housing 15 (the handle 30) to the right maximum steering angle. Then, the pivoting restricting protrusion 24 of the drive shaft housing 15 abuts against the left pivoting restricting portion 32, and is disposed so as to coincide with the passage allowing portion 35 of the swivel bracket 17 in a plan view (see a two-dot chain line shown in FIG. 3). Subsequently, the user lifts up the drive shaft housing 15, and the lower end of the swivel bracket 17 that is relatively pulled down abuts against the lower end restricting portion 23 of the drive shaft housing 15 (see FIG. 5). Then, the pivoting restricting protrusion 24 of the drive shaft housing 15 passes through the passage allowing portion 35 of the swivel bracket 17 from a lower side to an upper side, and moves to an upper side of the protruding portion 33 (see FIG. 6).

Next, the user pivots the drive shaft housing 15 (the handle 30) to an angle other than the right maximum steering angle. In this state, (a lower end of) the pivoting restricting protrusion 24 that is a part of the drive shaft housing 15 interferes with (an upper surface of) the protruding portion 33 for attaching the steering adjuster 36, and the drive shaft housing 15 is restricted from moving downward (see FIG. 6). That is, even when the drive shaft housing 15 is not supported by a hand of the user or a jig, the drive shaft housing 15 does not fall.

Next, the user disposes the spacer 60 on the sliding portion 21A that is exposed between the upper end restricting portion 22 of the drive shaft housing 15 and an upper end of the swivel bracket 17. More specifically, the user inserts the rotation stop protrusion 27 into a hole in an upper end surface of the swivel bracket 17 or the like, sets the rotation stop recessed portion 66 of the spacer rear portion 62 in a posture facing downward, and fits the rotation stop protrusion 27 into the rotation stop recessed portion 66. Then, the user sandwiches, between the spacer front portion 61 and the spacer rear portion 62, the sliding portion 21A that is exposed between the upper end restricting portion 22 of the drive shaft housing 15 and the upper end of the swivel bracket 17, and integrates the sliding portion 21A with the spacer front portion 61 and the spacer rear portion 62 by the bolts 67. Since the rotation stop protrusion 27 at the upper end of the swivel bracket 17 is fitted into the rotation stop recessed portion 66, the spacer 60 is restricted from rotating about an axis.

As described above, the spacer 60 adjacent to the lower end of the swivel bracket 17 is turned upside down and is mounted to the drive shaft housing 15 at a position adjacent to the upper end of the swivel bracket 17 (see FIGS. 5 and 6). In this case, the swivel bracket 17 is relatively pulled down by the height of the spacer 60, and the drive shaft housing 15 is lifted up with respect to the swivel bracket 17. Therefore, the outboard motor 1 has a short specification in which a dimension (L2 (L2<L1)) from a position (for example, a lower end surface) of the swivel bracket 17 to the rotation shaft (axial center) of the propeller 42 is shortened by the height (H) of the spacer 60 (see FIG. 5). That is, the outboard motor 1 has a specification in which a transom height is set to be short.

In the case of the short specification, since the upper portion (the housing connection portion 20) of the drive shaft housing 15 is separated upward from the upper end of the transom board 6 of the ship 5, it is preferable that the handle 30 is provided at a position close to the upper end of the transom board 6. Therefore, in the case of the short specification, the user removes the attachment 31 from the drive shaft housing 15, turns the attachment 31 upside down, and couples the attachment 31 to the drive shaft housing 15. The attachment 31 is fixed to the drive shaft housing 15 in a posture in which the support portion 31B is positioned below the coupling portion 31A. The handle 30 coupled to the support portion 31B is provided at a position close to the upper end of the transom board 6.

<Change from Short Specification to Long Specification>

A procedure for changing the specification from the short specification to the long specification is substantially the same as a procedure for changing the specification from the long specification to the short specification described above. Briefly, the user removes the attachment 31 from the drive shaft housing 15, turns the attachment 31 upside down, fixes the attachment 31 to the drive shaft housing 15, and couples the handle 30 to the support portion 31B located below the coupling portion 31A (see FIG. 1). Subsequently, the user positions the drive shaft housing 15 at an angle other than the right maximum steering angle, and removes the spacer 60 and the rotation stop protrusion 27. In this state, since the pivoting restricting protrusion 24 of the drive shaft housing 15 interferes with the protruding portion 33 of the swivel bracket 17, the drive shaft housing 15 does not fall (see FIG. 6). The removing and attaching operations of the attachment 31 may be performed after the spacer 60 is removed.

Next, after pivoting the drive shaft housing 15 to the right maximum steering angle, the user pulls down the drive shaft housing 15, and the upper end of the swivel bracket 17 that is relatively lifted up abuts against the upper end restricting portion 22 of the drive shaft housing 15 (see FIGS. 1 and 2). Then, the pivoting restricting protrusion 24 of the drive shaft housing 15 passes through the passage allowing portion 35 of the swivel bracket 17 from an upper side to a lower side, and moves to a lower side of the protruding portion 33 (see FIG. 2).

Next, the user inserts the rotation stop protrusion 27 into a hole in a lower end surface of the swivel bracket 17 or the like, and mounts the spacer 60 to the sliding portion 21A that is exposed between the lower end restricting portion 23 of the drive shaft housing 15 and the lower end of the swivel bracket 17 (see FIG. 2). As described above, the spacer 60 is mounted to the drive shaft housing 15 at a position adjacent to the lower end of the swivel bracket 17, and the outboard motor 1 is changed from the long specification to the short specification (see FIGS. 1 and 2).

In the outboard motor 1 according to the present embodiment described above, in a state in which the spacer 60 is mounted to the drive shaft housing 15, the drive shaft housing 15 is restricted from moving in the axial direction with respect to the swivel bracket 17 and the dimension (L1>L2) from the swivel bracket 17 to the rotation shaft of the propeller 42 is changed by changing a mounting position of the spacer 60. That is, the transom height is changed (adjusted) in accordance with the change of the mounting position of the spacer 60. According to such a configuration, a structure related to the adjustment of the transom height can be simplified and manufacturing cost can be reduced as compared with a case where the transom height is adjusted using an actuator such as a hydraulic cylinder. Accordingly, the transom height can be easily adjusted by a simple operation of changing the mounting position of the spacer 60.

In the outboard motor 1 according to the present embodiment, the drive shaft housing 15 can be moved in the upper-lower direction (axial direction) by being pivoted about an axis to the maximum steering angle (a predetermined angle) with respect to the swivel bracket 17. The mounting position of the spacer 60 is changed in a state in which the drive shaft housing 15 can be moved in the upper-lower direction. According to such a configuration, the drive shaft housing 15 does not move in the upper-lower direction unless the drive shaft housing 15 is pivoted to the maximum steering angle. Accordingly, it is possible to prevent the drive shaft housing 15 from moving in the upper-lower direction against the intention of the user.

In a state in which the drive shaft housing 15 (the handle 30) swings, it may be difficult to adjust the transom height (to move the drive shaft housing 15 in the upper-lower direction). In particular, it is difficult to move the drive shaft housing 15 in the upper-lower direction together with the upper unit 2 including the electric motor 11 which is a heavy object. As one solution for preventing such swinging of the drive shaft housing 15, it is conceivable to form a groove in the swivel bracket 17 and the groove is fitted to the pivoting restricting protrusion 24 of the drive shaft housing 15 at a predetermined angle.

On the other hand, in the outboard motor 1 according to the present embodiment, the predetermined angle at which the drive shaft housing 15 is allowed to move in the upper-lower direction is the maximum steering angle at which the drive shaft housing 15 is pivoted from a steering position at which the ship 5 travels straight up to a position where the drive shaft housing 15 is restricted from pivoting. According to such a configuration, the user can perform the transom height adjusting operation (move the transom height in the upper-lower direction) in a stable state in which the pivoting restricting protrusion 24 of the drive shaft housing 15 abuts against the pivoting restricting portion 32. Accordingly, the adjusting operation can be performed appropriately and quickly.

In the outboard motor 1 according to the present embodiment, in a case where the drive shaft housing 15 is positioned at an angle other than the maximum steering angle (the predetermined angle), a part of the drive shaft housing 15 (the pivoting restricting protrusion 24) interferes with the protruding portion 33 that protrudes radially inward from an inner surface of the swivel bracket 17 for attaching the steering adjuster 36, and the drive shaft housing 15 is restricted from moving in the axial direction (see FIG. 6). According to such a configuration, in a case where the drive shaft housing 15 is set to an angle other than the maximum steering angle and the spacer 60 adjacent to the upper end of the swivel bracket 17 is removed, since the pivoting restricting protrusion 24 interferes with the protruding portion 33, the drive shaft housing 15 can be prevented from falling vigorously together with the upper unit 2 and the like including the electric motor 11 which is a heavy object. Accordingly, in the transom height adjusting operation, an operator does not need to support the drive shaft housing 15 or the like with a hand or a jig, and the adjusting operation can be easily performed.

In the outboard motor 1 according to the present embodiment, the attachment 31 has a stepped shape in the upper-lower direction between the coupling portion 31A coupled to the drive shaft housing 15 and the support portion 31B that supports the handle 30. The attachment 31 is configured to change a height of the support portion 31B when the attachment 31 is turned upside down and can be coupled to the drive shaft housing 15. According to such a configuration, the height of the handle 30 (for example, a height from a ship bottom of the ship 5 to the handle 30) can be changed in accordance with the adjusted transom height.

Accordingly, it is possible to prevent a change in the height of the handle 30 due to a change in the transom height, and it is possible to provide good operability to the user.

Although the passage allowing portion 35 is formed at the left side of the swivel bracket 17 (the protruding portion 33) in the outboard motor 1 according to the present embodiment, the passage allowing portion 35 may be formed at the right side of the swivel bracket 17 or may be formed at both the left and right sides of the swivel bracket 17 (not shown). Although the passage allowing portion 35 is formed at a position where the pivoting restricting protrusion 24 that abuts against the pivoting restricting portion 32 passes through the passage allowing portion 35 in the upper-lower direction, the present invention is not limited thereto. As described above, the passage allowing portion 35 may be formed at a position (not shown) where the drive shaft housing 15 is pivoted to a predetermined angle that is different from the maximum steering angle and the pivoting restricting protrusion 24 passes through the passage allowing portion 35 in the upper-lower direction. That is, as long as the drive shaft housing 15 can be moved in the upper-lower direction (axial direction), basically, the predetermined angle can be freely set.

Although one spacer 60 is mounted to the drive shaft housing 15 at a position adjacent to the upper end or the lower end of the swivel bracket 17 in order to adjust the transom height in the outboard motor 1 according to the present embodiment, the present invention is not limited thereto. For example, a plurality of spacers 60 having the same or different heights may be prepared, and the plurality of spacers 60 may be mounted to the drive shaft housing 15 at positions adjacent to the upper end, the lower end, or both ends of the swivel bracket 17 (not shown). That is, at least one spacer 60 may be mounted to the drive shaft housing 15 at a position adjacent to at least one of both ends of the swivel bracket 17 in the upper-lower direction (axial direction). According to such a configuration, the transom height can be adjusted in three or more stages.

Although the spacer 60 is divided into two portions in the front-rear direction in the outboard motor 1 according to the present embodiment, the present invention is not limited thereto, and the spacer 60 may be divided into two portions in the left-right direction.

Although the rotation stop protrusion 27 is provided on an end surface in the upper-lower direction of the swivel bracket 17 and the like, and the rotation stop recessed portion 66 is provided in the spacer 60 in the outboard motor 1 according to the present embodiment, the present invention is not limited thereto. For example, a pair of rotation stop protrusions 27 may be fixed to both of the upper and the lower end surfaces of the swivel bracket 17 or the like (not shown). A pair of rotation stop recessed portions may be provided in both of the upper and the lower end surfaces of the swivel bracket 17, and a rotation stop protrusion may be provided on the spacer 60 (not shown).

Although the handle 30 is coupled to the drive shaft housing 15 via the attachment 31 in the outboard motor 1 according to the present embodiment, the present invention is not limited thereto. For example, instead of the handle 30, the outboard motor 1 may include a cable (not shown) connected to a steering device (not shown) mounted in the ship 5 in order to swing the drive shaft housing 15. In this case, the support portion 31B of the attachment 31 supports the cable. According to such a configuration, since a height of the cable (the support portion 31B) can be changed in accordance with the adjusted transom height by turning the attachment 31 upside down and coupling the attachment 31 to the drive shaft housing 15, it is possible to prevent problems such as the cable being forcibly bent.

Although the outboard motor 1 according to the present embodiment is divided into three portions of the upper unit 2, the middle unit 3, and the lower unit 4, the present invention is not limited thereto. For example, the outboard motor may be divided into two portions of an upper unit and a lower unit, or may be a single unit (neither of them is shown).

Although the outboard motor 1 according to the present embodiment uses the electric motor 11 as a power source, instead of the electric motor 11, a small internal combustion engine (for example, an internal combustion engine in which exhaust gas is open to the atmosphere) may be used as a power source, or a hybrid power source in which the electric motor 11 and the internal combustion engine are combined may be provided (none of them is shown).

The present invention can be modified as appropriate without departing from the scope or spirit of the invention which can be read from the claims and the entire specification, and the outboard motor accompanying such a change is also included in the technical concept of the present invention.

What is claimed is:

1. An outboard motor configured to be attached to a transom board of a ship, the outboard motor comprising:

a drive shaft housing accommodating a drive shaft that transmits power of a power source to a propeller;

a swivel bracket supporting the drive shaft housing such that the drive shaft housing is pivotable about an axis thereof and is movable in an axial direction thereof;

a steering adjuster attached to the swivel bracket and configured to increase or reduce a rotational resistance force of the drive shaft housing against the swivel bracket;

at least one spacer mounted to the drive shaft housing at a position adjacent to at least one of both ends of the swivel bracket in the axial direction so as to be removable from the swivel bracket;

a handle that pivots the drive shaft housing; and an attachment coupled to the drive shaft housing and supporting the handle, wherein in a state in which the spacer is mounted to the drive shaft housing, the drive shaft housing is restricted from moving in the axial direction with respect to the swivel bracket, a dimension from the swivel bracket to a rotation shaft of the propeller is changed by changing a mounting position of the spacer, the attachment has a stepped shape in the axial direction between a coupling portion coupled to the drive shaft housing and a support portion that supports the handle, and the attachment is configured to be turned upside down on being coupled to the drive shaft housing such that a height of the support portion is changed.

2. An outboard motor configured to be attached to a transom board of a ship, the outboard motor comprising:

a drive shaft housing accommodating a drive shaft that transmits power of a power source to a propeller;

a swivel bracket supporting the drive shaft housing such that the drive shaft housing is pivotable about an axis thereof and is movable in an axial direction thereof;

a steering adjuster attached to the swivel bracket and configured to increase or reduce a rotational resistance force of the drive shaft housing against the swivel bracket;

at least one spacer mounted to the drive shaft housing at a position adjacent to at least one of both ends of the swivel bracket in the axial direction so as to be removable from the swivel bracket;

a cable connected to a steering device mounted in the ship so as to pivot the drive shaft housing; and an attachment coupled to the drive shaft housing and supports the cable, wherein in a state in which the spacer is mounted to the drive shaft housing, the drive shaft housing is restricted from moving in the axial direction with respect to the swivel bracket, a dimension from the swivel bracket to a rotation shaft of the propeller is changed by changing a mounting position of the spacer, the attachment has a stepped shape in the axial direction between a coupling portion coupled to the drive shaft housing and a support portion that supports the cable, and the attachment is configured to be turned upside down on being coupled to the drive shaft housing such that a height of the support portion is changed.

3. An outboard motor configured to be attached to a transom board of a ship, the outboard motor comprising:

a drive shaft housing accommodating a drive shaft that transmits power of a power source to a propeller;

a swivel bracket supporting the drive shaft housing such that the drive shaft housing is pivotable about an axis thereof and is movable in an axial direction thereof;

a steering adjuster attached to the swivel bracket and configured to increase or reduce a rotational resistance force of the drive shaft housing against the swivel bracket;

at least one spacer mounted to the drive shaft housing at a position adjacent to at least one of both ends of the swivel bracket in the axial direction so as to be removable from the swivel bracket, wherein in a state in which the spacer is mounted to the drive shaft housing, the drive shaft housing is restricted from moving in the axial direction with respect to the swivel bracket, a dimension from the swivel bracket to a rotation shaft of the propeller is changed by changing a mounting position of the spacer, and the spacer is configured to be divided into two portions in the front-rear or left-right direction of the ship.

* * * * *